US005098080A

United States Patent [19]

Arnone et al.

[11] Patent Number: 5,098,080

[45] Date of Patent: Mar. 24, 1992

[54] SKI JUMP STACK HEIGHT SENSOR

[75] Inventors: Stephen C. Arnone, Rochester, N.Y.; Morton Silverberg, Westport, Conn.

[73] Assignee: Xerox Corporation, Stamford, Conn.

[21] Appl. No.: 630,052

[22] Filed: Dec. 19, 1990

[51] Int. Cl.[5] ..... B65H 31/10

[52] U.S. Cl. ..... 271/187; 271/217

[58] Field of Search ..... 271/187, 214, 215, 217, 271/315

[56] References Cited

U.S. PATENT DOCUMENTS

| | | | |
|---|---|---|---|
| 2,849,236 | 8/1958 | Beaulieu | 271/215 |
| 3,703,283 | 9/1970 | Abendroth et al. . | |
| 4,275,874 | 6/1981 | DiBlasio | 271/187 |
| 4,385,756 | 8/1980 | Beery . | |
| 4,431,177 | 8/1980 | Beery et al. . | |
| 4,431,178 | 2/1984 | Kokubo et al. | 271/187 |
| 4,469,320 | 9/1984 | Wenthe, Jr. . | |
| 4,470,590 | 9/1984 | Ariga et al. | 271/187 |
| 4,501,418 | 2/1985 | Ariga et al. | 271/187 |
| 4,513,958 | 4/1985 | Kokubo et al. | 271/187 |
| 4,589,645 | 5/1986 | Tracy . | |
| 4,714,394 | 12/1987 | Ehlscheid et al. | 271/187 |
| 4,770,405 | 9/1988 | Fukushima et al. | 271/187 |
| 4,969,641 | 11/1990 | Fukushima et al. | 271/187 |

FOREIGN PATENT DOCUMENTS

| | | | |
|---|---|---|---|
| 121176 | 6/1987 | Japan | 271/187 |
| 212665 | 9/1988 | Japan | 271/187 |

*Primary Examiner*—Robert P. Olszewski
*Assistant Examiner*—Steven M. Reiss
*Attorney, Agent, or Firm*—Finnegan, Henderson, Farabow, Garrett & Dunner

[57] ABSTRACT

A stack height sensor for stacked sheet members includes a switch having an actuator arm positioned adjacent to top edge of the stack at a predetermined level. A flexible "flogger" or "scuffer" element is moved along a path which first contacts the top surface of the sheet members, and then slides off the stack edge in the direction of the switch actuator arm. The switch actuator arm is adjusted such that the deflected path of the flexible flogger or scuffer element intercepts the switch for stack heights less than the predetermined value and "ski jumps" the switch actuator arm for stack heights greater than the predetermined height. The flogger or scuffer elements can be mounted on the disk inverter of a photocopier output section, and the switch output be used to control the position of the stack elevator mechanism. Alternatively a separate hub synchronized for rotation with the disk inverter, can be used to mount the flogger or scuffer elements.

14 Claims, 1 Drawing Sheet

SKI JUMP STACK HEIGHT SENSOR

BACKGROUND OF THE INVENTION

1. Field of the Invention

This invention pertains to apparatus for sensing the height of a stack of sheet members and also to apparatus for controlling the height of a stack of sheet members to a predetermined value.

2. Description of the Prior Art

Apparatus for sensing the height of a stack of sheet members are used in a variety of applications including in the output section of photocopiers. Conventional stack height sensors include not only noncontact optical, pneumatic or capacitive sensors but also mechanical contact sensors. Existing optical sensors, including those utilizing reflective optics, are susceptible to contamination, variation of sensitivity due to paper type, color, curl, stack, density and location of the sheet members at positions other than at the calibrated focal point of the sensor. Also, the possibility of faulty operation due to ambient light leakage also exist in such sensing systems. Conventional capacitative and pneumatic sensors are costly and/or have problems limting their usefulness.

Conventional "mechanical feeler" type stack sensors typically utilize a rigid finger element which is indexed into and out of engagement with the top of the stack, and representative of these devices are the apparatus shown in U.S. Pat. No. 4,469,320 (Wenthe Jr.) and U.S. Pat. No. 4,589,645 (Tracy). While such devices perform adequately, the mechanical assembles used to index and reposition the sensing arm are relatively complex. The complexity, in turn, directly effects the overall cost and the reliability of the apparatus, as one skilled in the art would readily appreciate.

Also, many of the contact type stack height sensors, for example the apparatus shown in Wenthe Jr., is suitable for stacks fed from the bottom. In many applications, e.g. photocopier disc stackers, the paper or other sheet member descends onto the stack. Such applications would effectively rule out the use of certain types of conventional contact sensors and, prior to the present invention, would have required the more costly and problem-prone optical or possibly pneumatic sensors.

Hence, there still exists the need for relatively low cost but reliable stack height sensing apparatus particularly apparatus which can be readily integrated with the feeding mechanism for the sheet members, such as in the output section of photocopiers.

SUMMARY OF THE INVENTION

In accordance with the present invention as broadly described and claimed herein, the apparatus for sensing the height of a stack of sheet members in relation to a predetermined height comprises switch means having an actuator element positioned adjacent a top edge of the stack at the predetermined height, and stack contacting means including at least one finger element movable in a direction substantially parallel to the surface of the top sheet member, along a path from a first position engageable with the top sheet member of the stack, across the stack top edge, and to a second position past the switch actuator element.

Preferably the finger member is resilient to bending in the stack height direction and is mounted on a disc member rotatable about an axis extending in a plane substantially parallel to the surface of the top sheet member.

It is further preferred that the disc member is an inverter disc having at least one sheet member carrying slot, and that the finger member is attached to the inverter disc adjacent the slot.

And it is still further preferred that the apparatus further includes elevator means for moving the stack in the stack height direction, and control means responsive to the switch means for controlling the elevator means.

The accompanying drawing, which is incorporated in and constitutes a part of this specification, illustrates preferred embodiments of the invention and, together with the description, serves to explain the principles of the invention.

Reference will now be made in detail to the present preferred embodiments of the invention which ar illustrated in the accompanying drawing.

DESCRIPTION OF THE PREFERRED EMBODIMENTS

Figure 1:
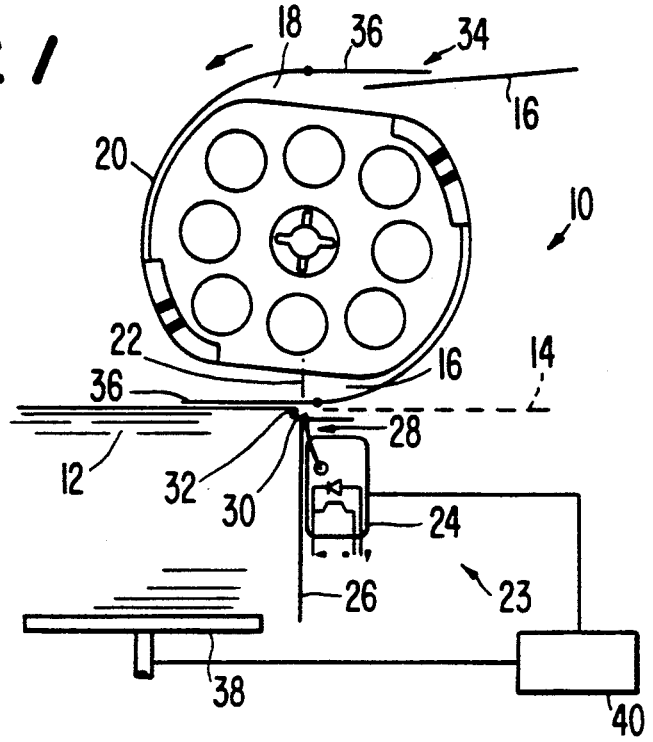
FIG. 1 is a schematic side view of a first embodiment of apparatus made in accordance with the present invention for sensing the height of a stack of sheet members.

With initial reference to FIG. 1, there is shown a first embodiment of apparatus for sensing the height of a stack of sheet members, which embodiment is designated generally by the numeral 10. As embodied herein, apparatus 10 acts to sense the height of sheet members 12 in the vertical direction relative to a predetermined stack height shown in the figure by a dotted line 14. The application depicted in FIG. 1 is the output section of a photocopier apparatus (not shown), but the present invention is not intended to be limited by this application but only by the appended claims.

In the embodiment disclosed in FIG. 1, a sheet of paper 16 exiting the developer section of the photocopier is received in slot 18 of a conventional disc inverter 20 for carrying to stack 12. As disc 20 rotates in the direction shown by the arrow the paper is carried in slot 18 until it reaches sheet stripping barrier 22 whereupon it is urged from slot 18 and settles gently in the vertical direction on stack 12. Disc inverters, such as disc inverter 20 shown in FIG. 1, are known in the art such as are disclosed in U.S. Pat. No. 4,385,756 and (Beery) U.S. Pat. No. 4,431,177, (Beery et al.) the disclosures of which are incorporated herein by reference.

In accordance with the present invention, switch means are provided including a switch actuator element positioned adjacent a top edge of the stack at the predetermined stack height. As embodied herein and with continued reference to FIG. 1, switch means 23 includes switch body 24 mounted on wall 26 of the copier apparatus adjacent to the location of stack 12. Operatively connected to switch body 24 is switch actuator arm 28 extending upwardly and having a tip portion 30 proximate edge 32 of stack 12, at the predetermined stack height 14. Switch actuator 28 is of the type that can be actuated by a right-ward directed horizontal force in the FIG. 1 depiction, for reasons that will become apparent from the succeeding discussion. Also, although mechanically activated via actuator arm 28, switch body 24 can be of the type which has an internal optical sensor. A currently preferred switch is an NAC 130K Series manufactured by the Cherry Corporation.

Further in accordance with the present invention, the height sensing apparatus includes stack contacting means including at least one finger element movable in a direction substantially parallel to the surface of the top sheet member in the stack. The finger element moves along a path from a first position engageable with the top sheet member of the stack, across the stack top edge, and to a second position past the switch actuator element. As embodied herein, and with continued reference to FIG. 1, stack contacting means designated generally by the numeral 34 includes two "flogger" type finger elements 36 attached to disc inverter 20 proximate the respective slots 18. The flogger elements 36 are preferably flexible at least in the radial direction with respect to disc inverter 20. The flogger material also preferably should exhibit a moderate amount of friction when in contact with the sheet member to assist in maintaining registration of the sheet member with a mechanical stop used to determine the position of stack 12, such as barrier 22 in the FIG. 1 apparatus. The resulting frictional engagement should be moderate, that is, sufficient to provide an urging force parallel to the plane of the sheet member but not tear or otherwise damage the sheet member. The flogger elements 36 can be formed of any of a variety of resilient elastomeric or plastic materials such as reinforced rubber, microcellular polyurethane (MCPU) or EPDM.

In operation, as disc inverter 20 rotates in the direction shown by the arrow in FIG. 1, the flogger elements 36 first engage the surface of the top sheet in stack 12, then are dragged over the stack edge 32, and eventually are carried to a position to the right of switch actuator arm 28 by the continued rotation of disc inverter 20. Depending upon the height of stack 12 relative to tip 30 of switch actuator 28, the flogger elements 36 either engage tip 30 and actuate switch body 24 or, if the stack height is greater than the predetermined height 14, the flogger elements 36 "ski-jump" over tip 30 such that switch body 24 is not actuated. In operation, the position of switch body 24 and actuator 28, including tip 30, can easily be adjusted to sense the height of stack 12 in relation to a predetermined 14 once the flexibility of flogger elements 36 is determined. Preferably switch body 14 can be adjustably mounted such that, with a minimum of testing, the optimum position for switch actuator 28 for a given stack height 14 can be easily determined.

It is also preferred that, apparatus 10 further includes stack elevator 38 movable in the height direction to raise and lower the stack 12 and elevator controller 40. Controller 40 is also operatively connected to switch body 24 as such that, when switch actuator element 28 is not activated for one or more rotations of disc inverter 20, thereby indicating that the predetermined height 14 has been exceeded, controller 40 causes elevator 38 to lower the top of stack 12 below predetermined height 14. It is also preferred that controller 40, which can be a microprocessor, is programmed to lower elevator 38 a predetermined amount based on the size or thickness of the individual sheet members which comprise stack 12.

One skilled in the art would realize that modifications and variations in the apparatus shown in FIG. 1 can be made without departing from the scope and spirit of the invention. For example, the flogger elements 36 can be mounted separately from the disc inverter and/or can be made to move in a direction different from the direction of rotation of disc inverter 20. Hence, switch body 24 could be mounted at the side of stack 12 and apparatus can be provided for mounting the flogger elements 36 and for having flogger elements 36 contact the top sheet of stack 12 and slide off a side edge (not shown) in the direction of the side-mounted switch. However, the apparatus as shown in FIG. 1 is preferred for several reasons. For example, it allows for sideside staggering of the paper stack 12, it permits the flogger elements to provide the additional function of urging the sheet members into registration against a mechanical stop such as barrier 22, and it achieves its extended function with a minimum of additional apparatus components.

Figure 2:
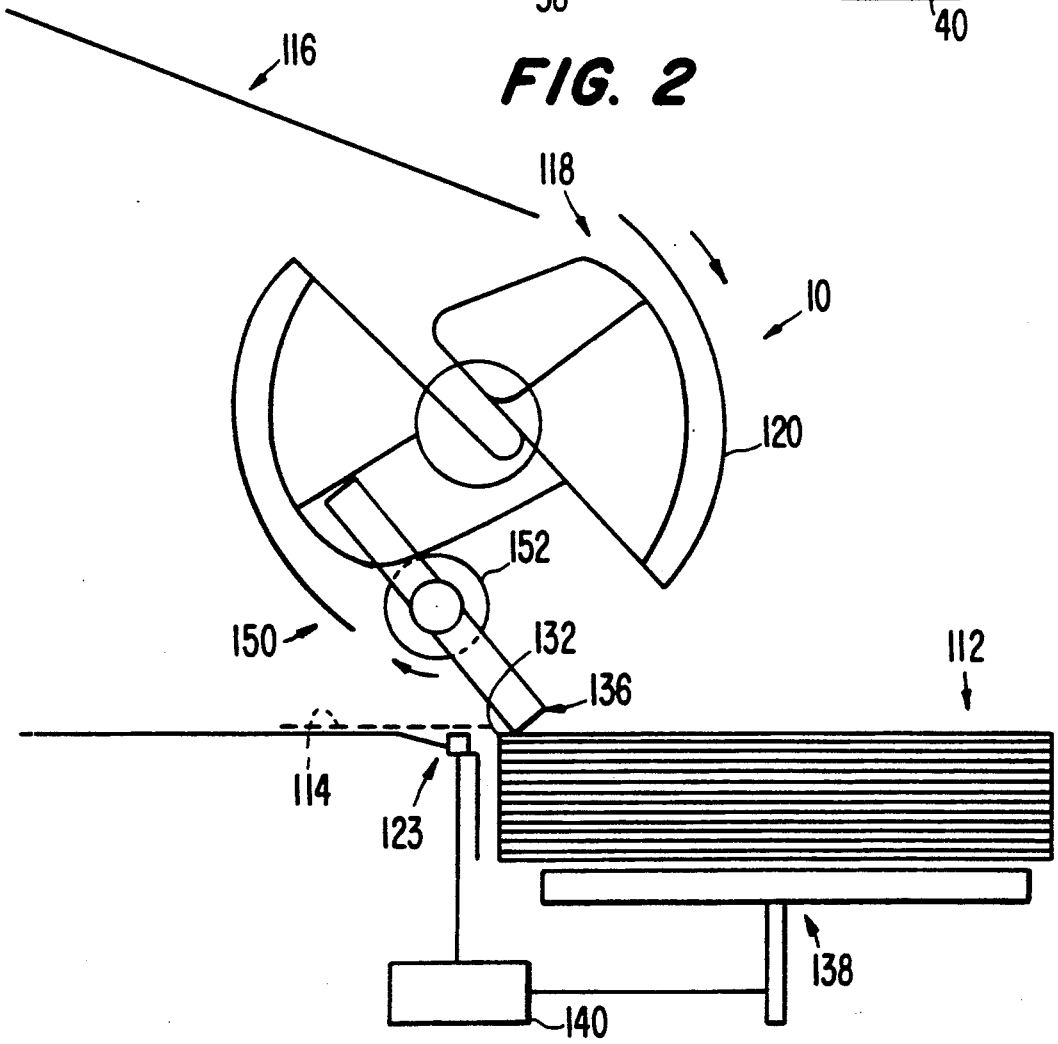
FIG. 2 is a schematic side view of a second embodiment made in accordance with the present invention.

FIG. 2 presents an alternative embodiment to that shown in FIG. 1. As shown in FIG. 2, apparatus designated generally by the numeral 110 (wherein like components are designated with like numbers but with the prefix "100" added thereto) includes a stack of sheet members 112 comprising multiple members 116 which are inverted and arranged in stacked order by disc inverter 120. Apparatus 110 which acts to control the height of 112 in relation to a desired stack height represented by the dotted line 114 includes switch means 123 mounted closely proximate edge 132 of stack 112 at the predetermined height 114. Stack elevator 138 controls the height of stack 112 in response to instructions from controller 140 which is operatively connected to switch means 123, in a manner which will be understood from the preceding discussion.

As embodied in the FIG. 2 depiction, stack contacting means includes resilient "scuffer blade" type finger elements 136 mounted for rotation with separate shaft means 150 including hub 152. Hub 152 is rotatable about an axis arranged parallel to the axis of disc inverter 120 and, preferably, is geared or otherwise constrained for rotation in synchronization with disc inverter 120. As in the preceding embodiment, the location of switch means 123 is adjusted such that following contact between the scuffer blade elements 136 and the top surface of stack 112, the scuffer blade elements 136 slide off stack edge 132 and either contact switch means 123, for stack heights below predetermined height 114, or "ski-jump" over switch means 123 for stack heights above height 114. As in the FIG. 1 embodiment, one skilled in the art would understand how to mount switch 123 in accordance with the desired stack height 114, such that the deflected path of the scuffer blade elements 136 will activate the switch means 123 for stack heights below 114 and not activate switch means 123 for stack heights greater than 114.

Prior to operation of the FIG. 2 embodiment, the initial location of elevator 138 can be set by moving one of the scuffer blade 136 into a position wherein switch means 123 is activated. Elevator 138 is then driven up under the control of controller 140 until the scuffer blade element 136 disengages from switch means 123. "Overdriving" elevator 138 slightly past the predetermined set point 114 helps to optimize the resulting position of elevator 138.

Controller 140 which can be a microprocessor can be programmed to allow one or more missed activations of switch means 123 before indexing elevator 138 down. Also, controller 140 can be programmed to index elevator 138 down an amount dependent upon the thickness or size of the individual sheet member being stacked. One skilled in the art would be able to readily program controller 140 given the above description.

It will be apparent to those skilled in the art that other modifications and variations can be made in the above described embodiments of the present invention without departing from the scope or spirit of the invention. Thus, it is intended that the present invention cover such modifications and variations provided they come within the scope of the appended claims and their equivalents.

What is claimed is:

1. Apparatus for sensing the height of a stack of sheet members in relation to a predetermined height, the apparatus comprising:

a. contact switch means having an actuator element positioned adjacent a top edge of the stack at the predetermined height; and b. stack contacting means including at least one finger element movable in a direction substantially parallel to the surface of the top sheet member, along a path from a first position engageable with the top sheet member of the stack, across said stack top edge, and to a second position engageable with said switch actuator element for stack heights less than the predetermined height and not engageable for stack heights greater than the predetermined height.

2. The apparatus as in claim 1 wherein said at least one finger element is resilient to bending in the stack height direction.

3. The apparatus as in claim 1 wherein said stack contacting mean includes a disc member rotatable about an axis extending in a plane substantially parallel to the surface of the top sheet member, and wherein said at least one finger element extends from and is rotatable with said disc member.

4. The apparatus as in claim 3 wherein said disc member is an inverter disc having at least one sheet member carrying slot, and wherein said at least one finger element is attached to said inverter disc adjacent said slot.

5. The apparatus as in claim 1 further including:

c. elevator means for moving the stack in the stack height direction; and d. control means responsive to said switch means for controlling said elevator means.

6. The apparatus as in claim 5 wherein said control means lowers the position of the stack a predetermined amount when the height of the top sheet member exceeds the predetermined height, said predetermined amount being based upon the thickness or size of the individual sheet member.

7. Apparatus for inverting and stacking sheet members to a predetermined height, the apparatus comprising:

a. inverter means including a rotatable inverter disc having at least one sheet member carrying slot;

b. stacking means for receiving individual sheet members from said carrying slot in stacked relationship;

c. contact switch means having an actuator element positioned proximate the location of a top edge of the stack at the predetermined height;

d. stack contacting means including at least one finger element movable in a direction substantially parallel to the surface of the top sheet member from a first position engageable with the top member of the stack, across said top edge, and to a second position engageable with said switch actuator element for stack heights less than the predetermined eight and not engageable for stack heights greater than the predetermined height, the movement of said one finger element being interrelated with the rotation of said inverter disc for moving said finger element at least after receipt of each sheet member; and e. control means responsive to said switch means and operatively connected to said stacking means for lowering the stack.

8. The apparatus as in claim 7 wherein said at least one finger element is connected to said inverter disc adjacent said sheet member carrying slot.

9. The apparatus as in claim 7 wherein said stack contacting means includes a hub rotatable about an axis parallel to the stacked sheet members and said at least one finger element is connected to said hub, the rotation of said hub being synchronized with the rotation of said inverter disc.

10. The apparatus as in claim 7 wherein said finger element is resilient to bending in the stack height direction.

11. The apparatus as in claim 7 wherein said switch actuator arm is positioned directly in the path of said finger element for heights of said top sheet member below the predetermined height, and wherein said actuator arm is outside the path of said finger element for top sheet member heights above the predetermined height.

12. The apparatus as in claim 7 wherein said control means lowers said stacked sheet members a predetermined amount based on the thickness or size of the individual sheet members.

13. The apparatus as in claim 7 wherein said inverter means further includes mechanical stop means for urging the sheet members from said carrying slot, and wherein said stack contacting means also comprises means for providing registration of the sheet members relative to said mechanical stop means.

14. The apparatus as in claim 13 wherein said finger element is formed from a material providing a moderate frictional engagement with the sheet member.

* * * * *